US007090295B2

(12) United States Patent
Bodinek

(10) Patent No.: US 7,090,295 B2
(45) Date of Patent: Aug. 15, 2006

(54) ROCKING CHAIR

(76) Inventor: Margrit Bodinek, Fliederbogen 1, D-24963 Tarp (DE)

( * ) Notice: Subject to any disclaimer, the term of this patent is extended or adjusted under 35 U.S.C. 154(b) by 0 days.

(21) Appl. No.: 10/525,272

(22) PCT Filed: Sep. 24, 2003

(86) PCT No.: PCT/DE03/03184

§ 371 (c)(1),
(2), (4) Date: Feb. 22, 2005

(87) PCT Pub. No.: WO2004/028303

PCT Pub. Date: Apr. 8, 2004

(65) Prior Publication Data

US 2005/0264068 A1 Dec. 1, 2005

(30) Foreign Application Priority Data

Sep. 26, 2002 (DE) ..... 102 45 173

(51) Int. Cl.
*A47D 13/10* (2006.01)

(52) U.S. Cl. ..... 297/273; 297/258.1
(58) Field of Classification Search ..... 297/258.1, 297/273, 281, 259.1, 344.24
See application file for complete search history.

(56) References Cited

U.S. PATENT DOCUMENTS

| | | | | |
|---|---|---|---|---|
| 4,108,415 | A * | 8/1978 | Hauray et al. | 248/370 |
| 5,248,120 | A | 9/1993 | Brien | |
| 5,344,214 | A * | 9/1994 | Trent | 297/270.2 |
| 5,427,433 | A * | 6/1995 | Holobaugh, Jr. | 297/273 |
| 5,558,397 | A * | 9/1996 | Chang | 297/281 |
| 5,630,646 | A | 5/1997 | Trimble | |
| 5,795,021 | A * | 8/1998 | Rogers | 297/281 |
| 5,988,753 | A * | 11/1999 | Lin | 297/423.26 |
| 6,092,870 | A * | 7/2000 | Desnoyers et al. | 297/281 |
| 6,106,062 | A | 8/2000 | Ambrose, Jr. et al. | |
| 6,241,315 | B1 * | 6/2001 | Chiang | 297/259.3 |

* cited by examiner

*Primary Examiner*—Milton Nelson, Jr.
(74) *Attorney, Agent, or Firm*—Larson & Larson, PA; Herbert W. Larson

(57) ABSTRACT

A rocking chair with an oscillating base, a seat affixed to the base and a back rest. The seat is provided with two downwardly projecting struts connected to lower oscillating sections at the lower ends, each section connected to an oscillating parallelogram formed by oscillating rods whereby the upper sections of the parallelogram are mounted inside the downwardly projecting struts at the bottom. The downwardly projecting struts are formed as a single component with a downwardly open U-shaped holding arc having flat lateral surfaces attached to the lower oscillating longitudinal sections. The upper sections are rotatably mounted inside the U-shaped holding arc as transversal carriers of a column affixed to a base plate.

7 Claims, 4 Drawing Sheets

ROCKING CHAIR

PRIOR APPLICATIONS

This §371 National Phase patent application bases priority on International Application No. PCT/DE2003/003184, filed on Sep. 24, 2003, which in turn bases priority on German Application No. DE 102 45 173.7, filed on Sep. 26, 2002.

BACKGROUND OF THE INVENTION

1. Field of the Invention

The invention relates to a rocking chair with an oscillating base, a seating surface fixed thereto and a back rest according to the preamble of the main claim.

2. Description of the Prior Art

Such rocking chairs differ from those which normally have arcuate runners in the lower region on which they can oscillate backwards and forwards in that they are provided in a base with a swinging or oscillating mechanism enabling them to be installed on carpets, where a conventional runner-type rocking chair would be excessively decelerated, so as to enable rocking to take place in much the same way as with a conventional rocking chair. However, unlike in the case of the latter, the back rest stays in its horizontal inclination and the latter does not change during rocking.

Conventionally, oscillating bases with oscillating, pendulum or tension parallelograms are used, where soon an unsteady impression is given to the chair as a result of the numerous lever arms and joints. This is not desired, and what is, in fact, required is a steady rocking adapted to a soft, easy chair, together with long-term durability.

The problem also arises that some of these rocking chairs, and in particular those made from wood, constructed with rods which closely slide past one another and in which small children, pets or even the user can unintentionally engage or intervene, and can be subject to significant injury levels during chair movement.

Therefore, the problem of the invention is to provide a stable construction for a rocking chair where such disadvantages do not arise. At the same time, a very comfortable, far-reaching oscillating movement with low overall height is to be ensured.

SUMMARY OF THE INVENTION

This problem is solved with a rocking chair having the features of the main claim. Advantageous developments are provided by the subclaims.

It is particularly advantageous that a downwardly open, U-shaped device has a holding arc with struts to the seating surface and serves as a central fixing and covering device, whilst also being constructed in such a solid way that there can be no clearance between the seating surface and the holding arc. Said holding arc is constructed with flat legs, which at their downwardly open ends are connected to the lower section of an oscillating parallelogram, so that joints or articulations are only tension loaded.

Thus, in T-shaped manner, the end sections of the holding arc are connected with elements at right angles thereto extending substantially parallel to the floor and still firmly connected to the seating surface whereby to said elements are attached, by means of swivel joints and in substantially vertical manner, rods which are inclined outwards away from the center of the holding arc and preferably in the upwards direction and which, in an upper area of the oscillating parallelogram and just below the seating surface, are connected to cross-members which are loaded on a supporting column in which there may optionally be a vertical adjustment, and can be rotated with respect to a base plate, but whose inclination is fixed with respect to the floor.

As a result of the inclined oscillating rods with an arrangement at the end of the cross-member, it is ensured that even with the maximum rocking movement, the U-shaped arc cannot so closely correspond with the upper ends of the oscillating support that jamming in is possible. In the lower area, the U-shaped arc is connected to the support elements so that also here the oscillating rods cannot jam.

As a result of the chosen flat construction of the U-shaped holding arc, there can also be no jamming contact with the supporting column.

According to a preferred embodiment, on the U-shaped holding arc is also provided a locking bolt with a handle projecting over the casing, so that the bolt mounted on the holding arc can engage in corresponding bolt receptacles on the cross-member fixed to the column. The bolts are preferably constructed in such a way that a rod operated with the handle engages in the same way in both cross-members enabling the chair to be locked in a specific oscillating position.

To additionally avoid engagement in the mechanism, a fixed casing can be attached to said cross-members, which are still fixed with respect to the base plate, but optionally rotatable with the cross-members, having solely in an upper area where the struts are provided between the legs and the U-shaped holding arc one or more optionally slot-like openings through which the struts can pass when rocking.

Laterally, and in particular, adjacent to the oscillating rods, the casing always has a covering action so that no engagement is possible. In its lower region the casing extends to just above a base plate and can optionally also be provided with a brush-like edge to ensure that no dust penetrates from below into the casing. Simultaneously, during chair rotation dust is cleaned from the base plate in this way.

The desired rigidity of the means results more especially, from the extremely stable constructed lower longitudinal sections of the oscillating parallelogram, preferably welded over a long area of the flat lateral surface of the U-shaped holding arc. There are only eight swivel points in the parallelogram lever system which are located in the four extremities of the oscillating rods and are uniformly loaded during oscillation. The U-shaped holding arc ensures that transverse loads are uniformly introduced into the parallelogram lever system.

BRIEF DESCRIPTION OF THE DRAWINGS

Further advantages and features of the present invention can be gathered from the following description of the preferred embodiment relative to the attached drawings, wherein.

DETAILED DESCRIPTION OF THE PREFERRED EMBODIMENT

Figure 1:
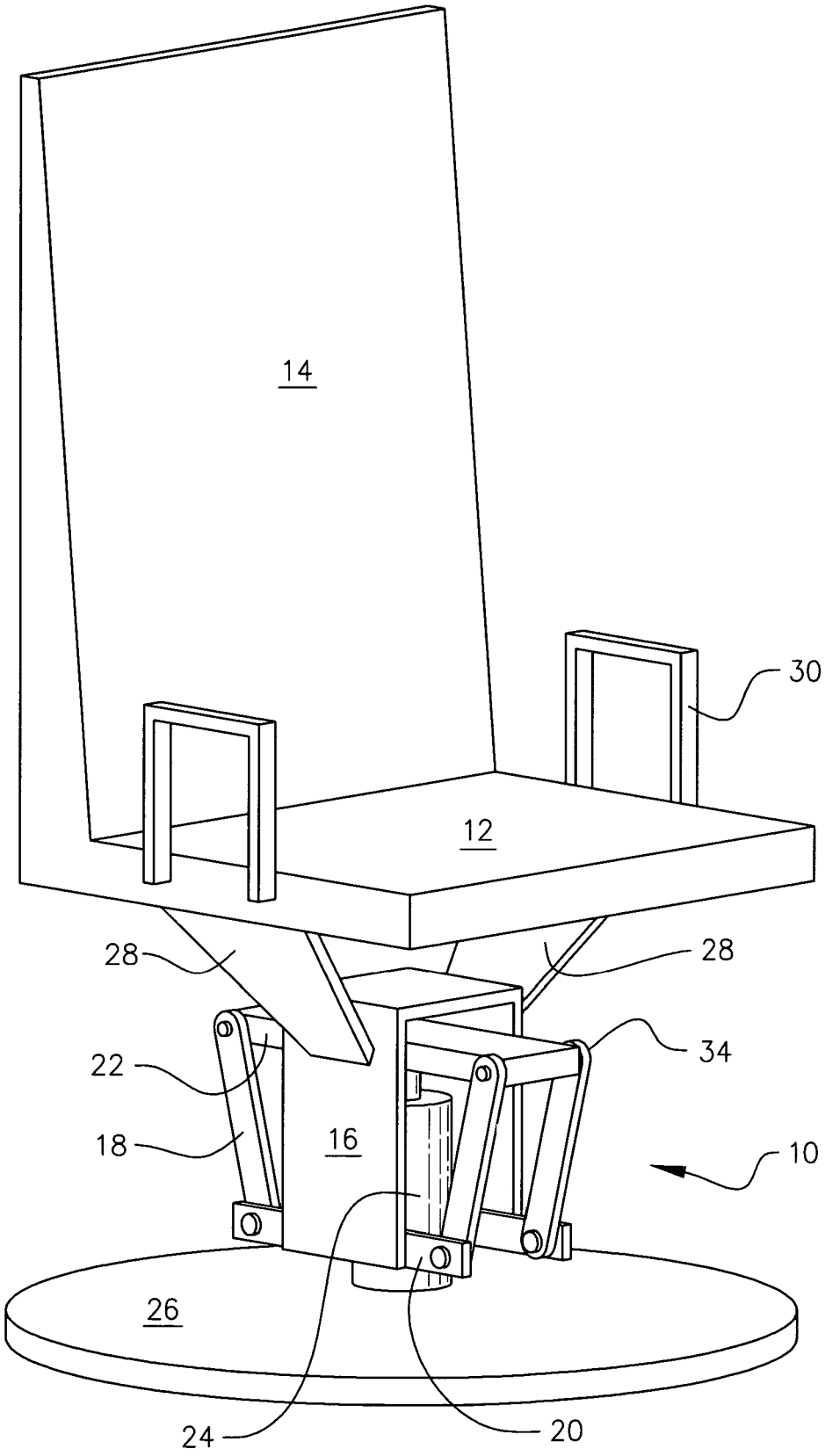
FIG. 1 shows a perspective view of a rocking chair according to the invention with a still uncased oscillating base.

The rocking chair shown in FIG. 1 rests with its base plate 26 on a random floor surface. The seating surface 12 and back rest 14 are connected by means of struts 28 (which unlike what is shown in the drawing preferably engage on the arm rests 30) with a U-shaped, downwardly open holding element 16 connected to an oscillating parallelogram. The latter has four oscillating rods 18, which are positioned substantially vertically, but in the upper area in outwardly sloping manner between cross-members 20, 22. In not shown manner, the seating surface and back rest are provided with a conventional recliner mechanism which, in the case of a rearward inclination of the back rest, advances the seating surface so that the center of gravity is maintained.

Figure 2:
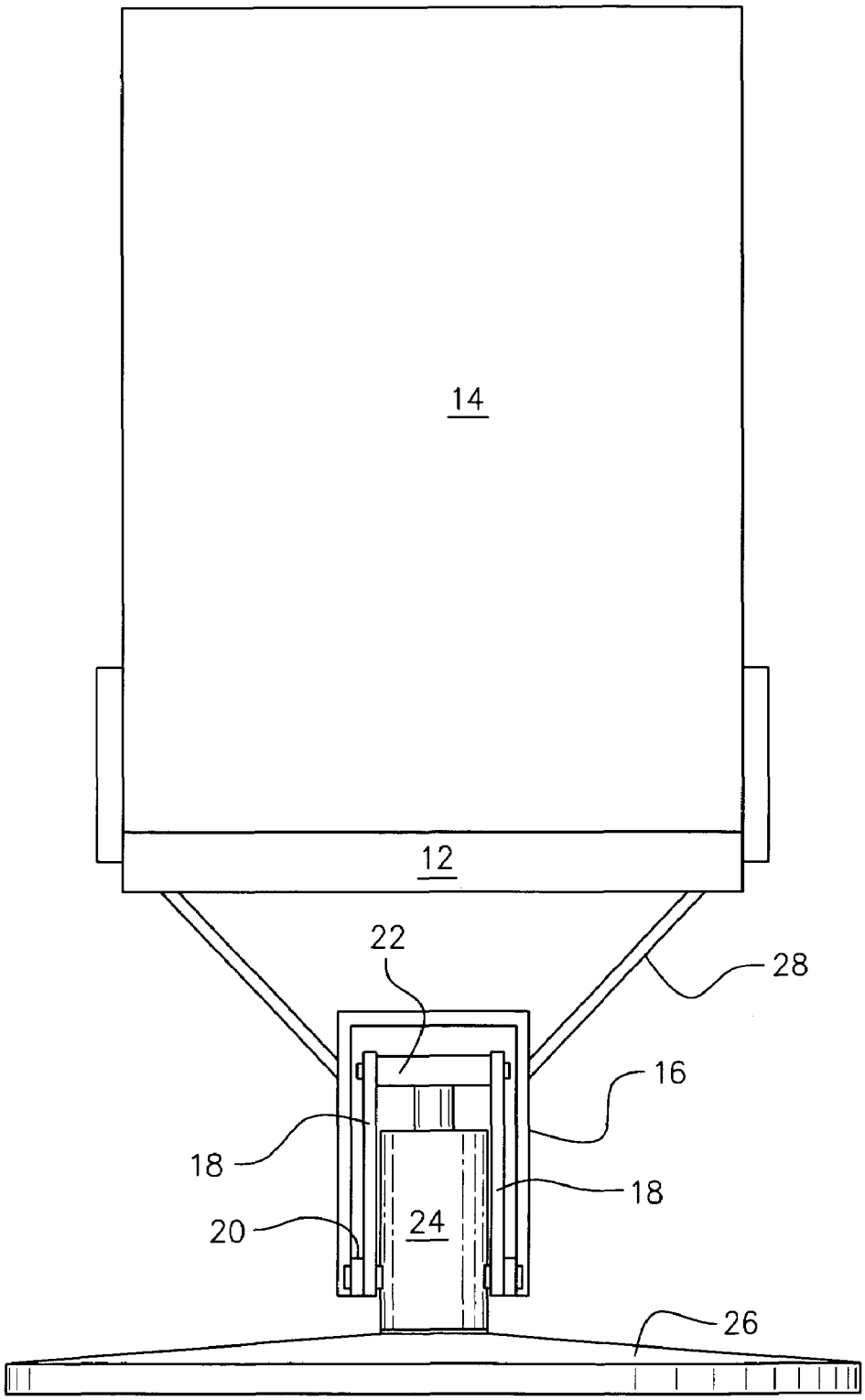
FIG. 2 shows a view of the back of the rocking chair.

In FIG. 2, the same structure is shown from the back. Additionally, there is a casing shown in broken line form, and carrying the reference numeral 32, which engages closely on the U-shaped holding arc but which, preferably at point 34, is not fixed to said holding arc but instead to the cross-members 22 fixed to the base plate, but optionally rotatable.

Figure 3:
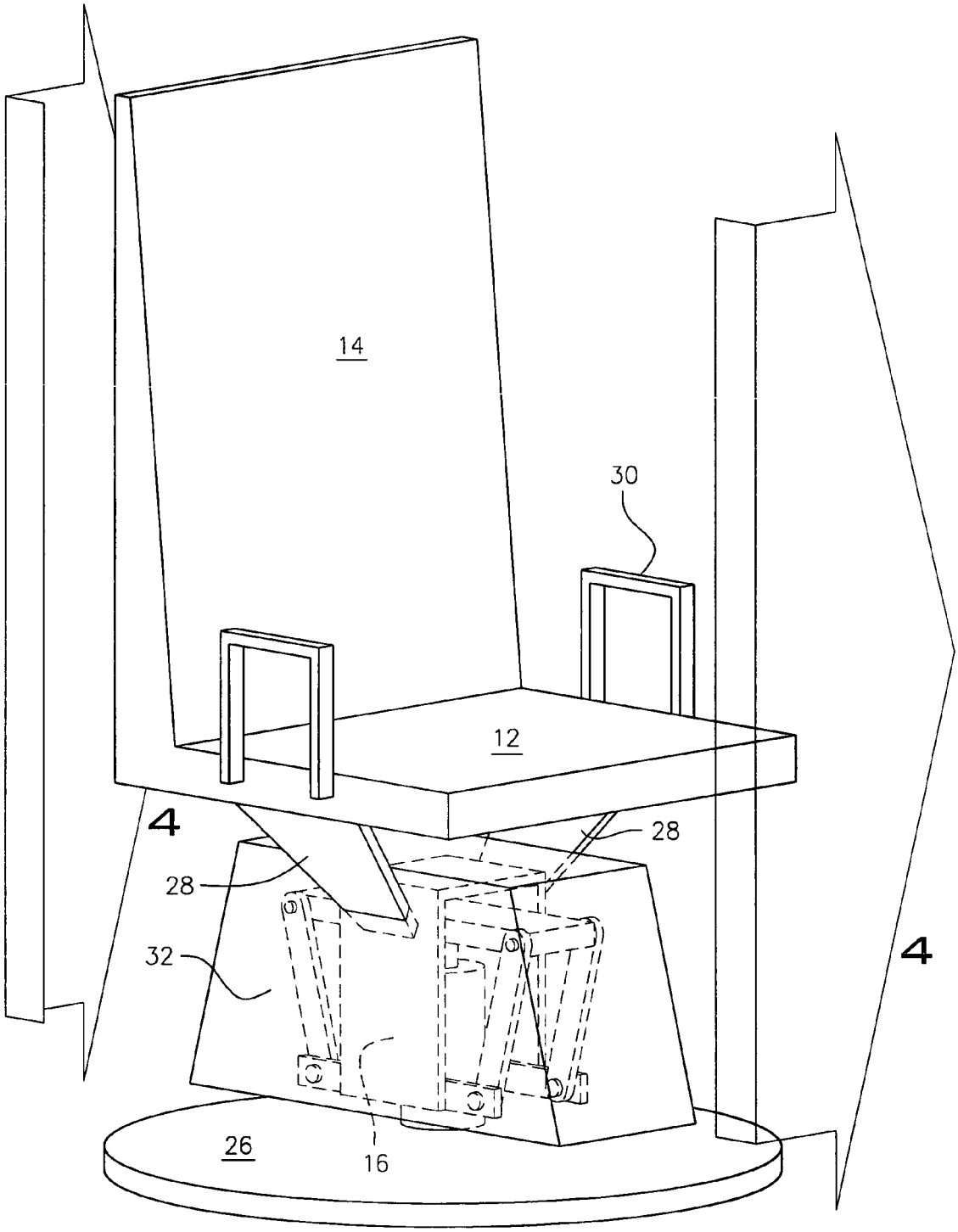
FIG. 3 shows a view corresponding to FIG. 1 wherein the rocking chair casing covers the oscillating base.
Figure 4:
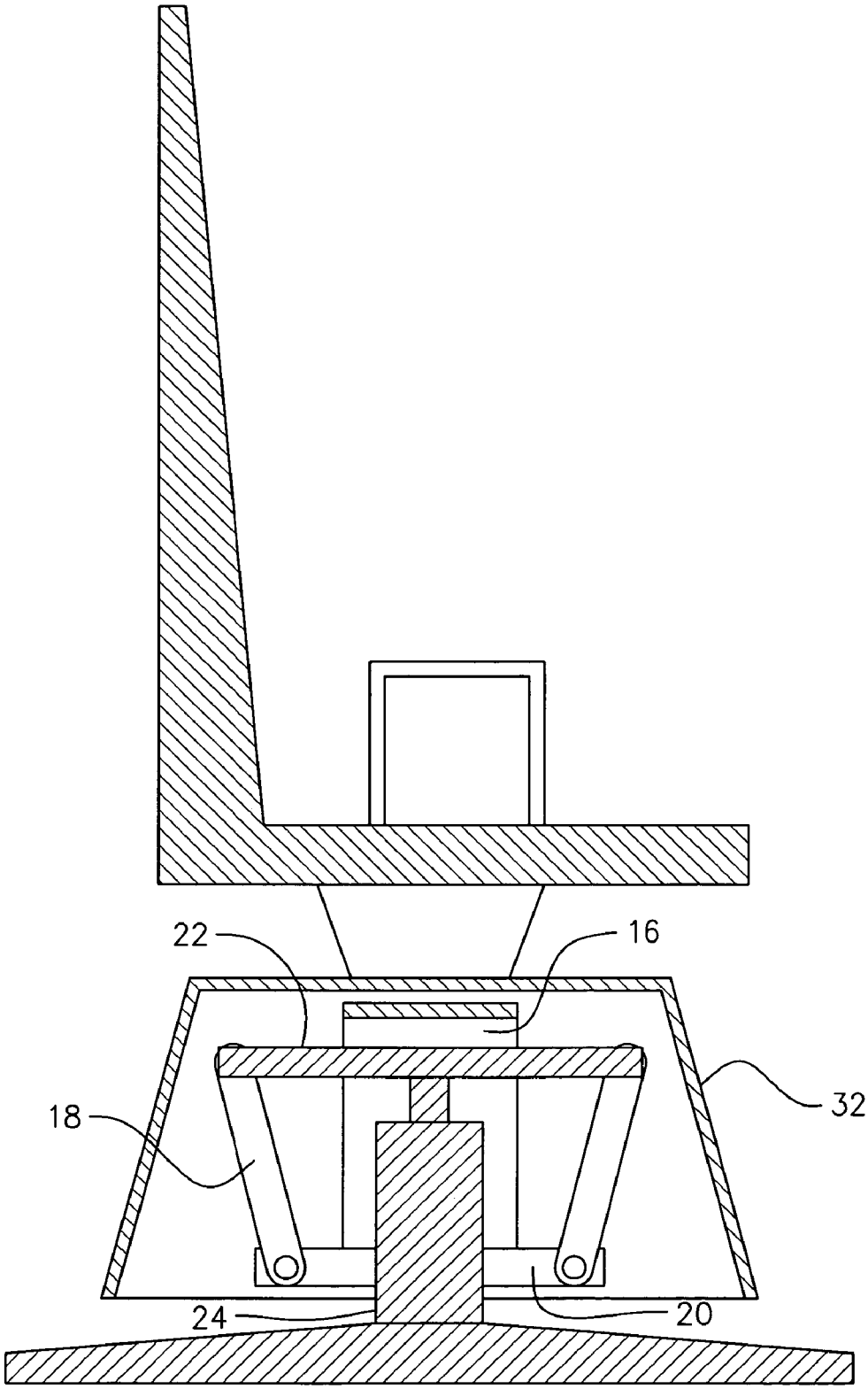
FIG. 4 shows a sectional view along lines 4—4 in FIG. 3.

FIG. 3 shows the casing 32 in perspective. FIG. 4 shows from the side the top of the casing 32 constructed arcuately in the vicinity of the holding arc for providing a movement possibility for the struts 28. It is clearly possible to see the oscillating parallelogram with the oscillating rods 18 between the upper cross-member 22 and the lower cross-member 20, the holding arc 16 already being moved slightly forwards with respect to the column 24.

In a preferred, not shown embodiment, a bolt is provided on the holding arc 16, and is preferably equipped with two projections or stud portions engaging in corresponding, multiple provided notches or holes so as to lock the chair in a random position. For this purpose, in much the same way as the top of the casing 32, the element 22 can be arcuately constructed corresponding to the oscillating movement of element 16. Alternatively, an additional arcuate perforated rail can be provided.

In a preferred embodiment, there is also a movement-synchronized foot stool which can also be attached in the holding arc 16 by means of corresponding stable struts. A reliable fixing of the struts can be ensured by a width of the lateral portions of the holding arc, substantially corresponding to the width of the arm rests, i.e. representing a multiple of the oscillating rod width.

Having thus described the invention, what is claimed and desired to be secured by Letters Patent is:

1. A rocking chair with an oscillating base, a seat affixed to the oscillating base and a back rest, the seat connected to two downwardly projecting struts provided with oscillating-mounted sections at their lower ends forming an oscillating parallelogram, the rocking chair further comprising:

the downwardly projecting struts integrally formed with a downwardly open U-shaped holding arc below the seating surface, the holding arc having opposed flat legs in the form of lateral surfaces;

the oscillating parallelogram formed by an upper cross member, a pair of parallel spaced apart lower cross members and two pair of upright oscillating rods, each pair of upright oscillating rods connected to an end portion of the upper cross member and connected inboard from an end portion of the lower cross members;

the flat legs each attached to one of the pair of parallel spaced apart lower cross members at opposed side edges; and the upper cross member held in a rotary manner by a column affixed to a base plate within the U-shaped holding arc.

2. The rocking chair according to claim 1, wherein the oscillating parallelogram has a trapezoidal shape.

3. The rocking chair according to claim 1, wherein the pair of parallel spaced apart lower cross members are slightly longer than the length of the oscillating rods.

4. The rocking chair according to claim 3, wherein the upper cross-member has a greater length than the length of the oscillating rods.

5. The rocking chair according to claim 4, wherein the upper cross-member is 1.5 times the length of the oscillating rods.

6. The rocking chair according to claim 1, wherein the oscillating rods are vertically inclined by 7° to 15°.

7. The rocking chair according to claim 1, wherein a casing encloses the oscillating parallelogram and has a brush edge which extends to the base plate.

* * * * *